US006712408B2

(12) United States Patent
Stepp et al.

(10) Patent No.: US 6,712,408 B2
(45) Date of Patent: Mar. 30, 2004

(54) SWING COVER DOOR PROP DEVICE FOR AN ELECTRIC COUPLER USED ON A PASSENGER TRANSIT VEHICLE

(75) Inventors: Jerry L. Stepp, Spartanburg, SC (US); Donald R. Cruitt, Lyman, SC (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/090,900

(22) Filed: Mar. 5, 2002

(65) Prior Publication Data

US 2002/0145290 A1 Oct. 10, 2002

Related U.S. Application Data

(60) Provisional application No. 60/273,846, filed on Mar. 8, 2001.

(51) Int. Cl.[7] ..... E05C 17/16
(52) U.S. Cl. ..... 292/268
(58) Field of Search ..... 439/142; 174/67; 312/292, 293, 294, 295, 296, 297, 298, 299, 330; 292/219, 268, 270, 262

(56) References Cited

U.S. PATENT DOCUMENTS 3,770,160 A * 11/1973 Flider ..... 220/318
4,156,551 A * 5/1979 Nagase et al. ..... 439/35
4,483,652 A * 11/1984 Barry ..... 414/392
6,173,849 B1 * 1/2001 Stevens et al. ..... 213/1.3

* cited by examiner

*Primary Examiner*—Lynn Feild
*Assistant Examiner*—Phuong K Dinh
(74) *Attorney, Agent, or Firm*—James Ray & Associates

(57) ABSTRACT

A swing door cover prop device for an electric coupler used on passenger transit vehicle for providing a mechanism to prop open a bottom mount style swing cover disposed adjacent the bottom of such electric coupler. Such swing door cover prop device includes an elongated door prop member having a first end and a second end. There is a slot disposed adjacent such first end of the door prop member for engaging a latch bolt disposed on such swing cover. A mechanism is provided which is engageable with the second end of such door prop member for pivotably connecting such door prop member to a swing cover arm of such electric coupler. The final essential element is a spring disposed between such door prop member adjacent the second end thereof and such swing cover arm for exerting a positive pressure on such door prop member.

5 Claims, 3 Drawing Sheets

SWING COVER DOOR PROP DEVICE FOR AN ELECTRIC COUPLER USED ON A PASSENGER TRANSIT VEHICLE

CROSS REFERENCE TO RELATED APPLICATION

This application is based on and claims priority from our co-pending U.S. Provisional Patent Application, entitled "ELECTRIC COUPLER SWING COVER DOOR PROP DEVICE", which was filed on Mar. 8, 2001 and was assigned Ser. No. 60/273,846.

FIELD OF THE INVENTION

The present invention relates, in general, to electric type couplers which are utilized on passenger transit type railway vehicles to transmit electrical signals along the entire length of the train and, more particularly, this invention relates to a swing cover door used on such electric couplers and, still more particularly, the present invention relates to a prop device for maintaining such swing cover door in an open position when necessary.

BACKGROUND OF THE INVENTION

As is generally well known in the passenger transit art, mass transit type railway vehicles utilize electric couplers. To insure the proper operation of these electric couplers they are generally subjected to routine cleaning and maintenance. Additionally, as is also well known, these electric couplers utilize numerous electrical contacts. Consequently, it is necessary to clean and periodically replace these electrical contacts in order to ensure proper propagation of electrical signals between the transit vehicles.

Electric couplers used on passenger transit type vehicles normally include a spring loaded swing cover mechanism. This spring loaded swing cover mechanism is used to protect the contacts and contact blocks from detrimental moisture and debris. As is also known, in order to access the electrical contacts and contact block, the swing cover mechanism must be rotated approximately 35 degrees and locked into position to counteract the opposing force being exerted by the swing cover spring.

Once the servicing of the electrical contacts and contact block is completed, the swing cover mechanism must be returned to its normal position.

SUMMARY OF THE INVENTION

The present invention provides a swing cover door prop device for an electric coupler used on a passenger transit vehicle. Such swing cover door device includes an elongated door prop member having a first end and a second. There is a slot disposed adjacent such first end of the door prop member for engaging a latch bolt disposed on such swing cover. A means is provided which is engageable with the second end of such door prop member for pivotally connecting such door prop member to a swing cover arm of such electric coupler. The final essential element is a spring means disposed between such door prop member adjacent the second end thereof and such swing cover arm for a exerting a positive pressure on such door prop member.

OBJECTS OF THE INVENTION

It is, therefore, one of the primary objects of the present invention to provide an enhanced means of propping open a bottom mount style swing cover disposed adjacent the bottom of an electric coupler utilized on a mass transit vehicle.

Another object of the present invention is to provide an enhanced means of propping open a bottom mount style swing cover disposed adjacent the bottom of an electric coupler utilized on a mass transit vehicle which will make servicing such electric coupler much simpler.

Still another object of the present invention is to provide an enhanced means of propping open a bottom mount style swing cover disposed adjacent the bottom of an electric coupler utilized on a mass transit vehicle which well minimize the chances for accidents to occur to maintenance personnel.

Yet another object of the present invention is to provide an enhanced means of propping open a bottom mount style swing cover disposed adjacent the bottom of an electric coupler utilized on a mass transit vehicle which is relatively inexpensive to manufacture.

A further object to the present invention is to provide an enhanced means of propping open a bottom mount style swing cover disposed adjacent the bottom of an electric coupler utilized on a mass transit vehicle which is relatively simple to operate.

Still yet another object of the present invention is to provide an enhanced means of propping open a bottom mount style swing cover disposed adjacent the bottom of an electric coupler utilized on a mass transit vehicle which can incorporate a means therein to automatically retract and stow the prop when it is not in use.

In addition to the various objects and advantages of the present invention which have been described in some detail above, it should be obvious that various other objects and advantages of the invention will become more readily apparent to those persons who are skilled in the relevant art from the following more detailed description of the invention, particularly, when such detailed description is taken in conjunction with the attached drawing figures and with the appended claims.

BRIEF DESCRIPTION OF A PRESENTLY PREFERRED AND

VARIOUS ALTERNATIVE EMBODIMENTS OF THE PRESENT INVENTION

Figure 1:
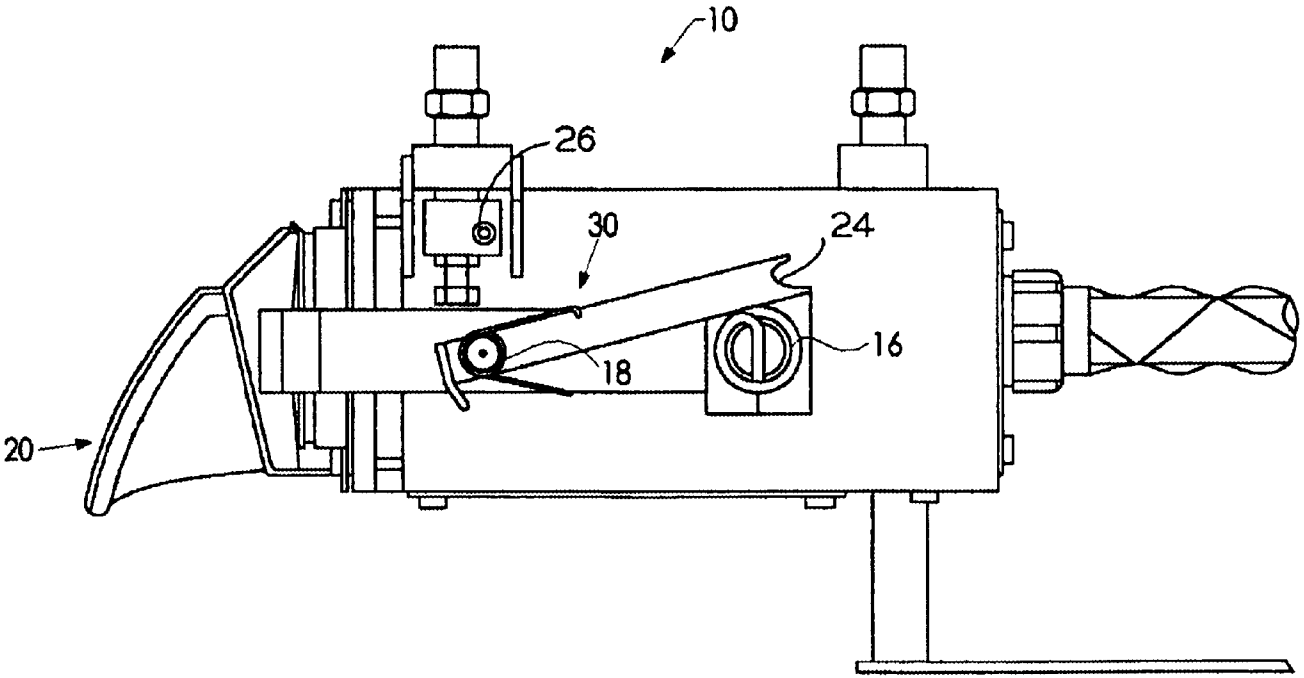
FIG. 1 is a side elevation view of an electric coupler utilized on a mass transit vehicle which depicts a presently preferred embodiment of the invention when it is in the stowed position.

Prior to proceeding to the more detailed description of the present invention it should be noted that, for the sake of clarity and understanding, identical components which have identical functions have been identified with identical reference to numerals throughout the several views illustrated in the drawings.

The typical bottom style electric coupler swing cover prop configuration consists of a prop attached to the swing cover arm via a stripper bolt. This connection further constitutes the prop pivot point. The opposing end of the prop contains a slot which engages a prop screw inserted into the side of the electric coupler case.

Figure 2:
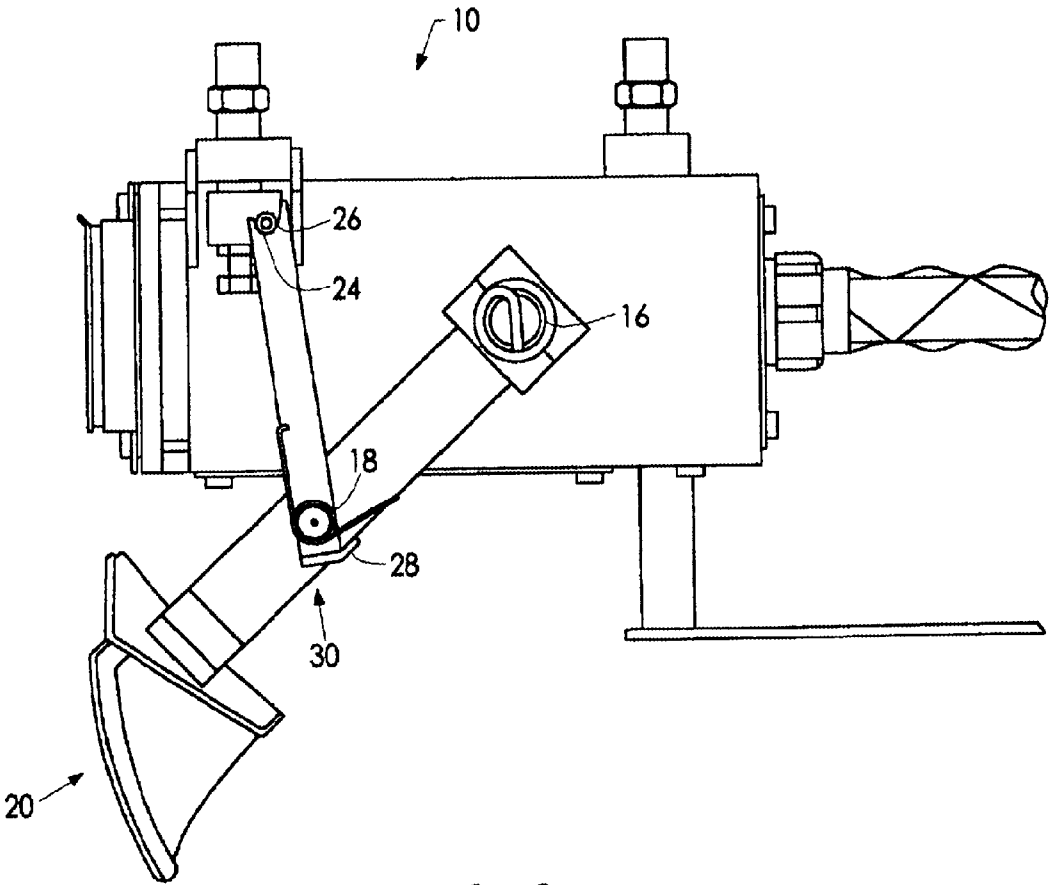
FIG. 2 is a side elevation view of the electric coupler illustrated in FIG. 1 depicting the presently preferred embodiment of the invention when it is in the propped open position.
Figure 3:
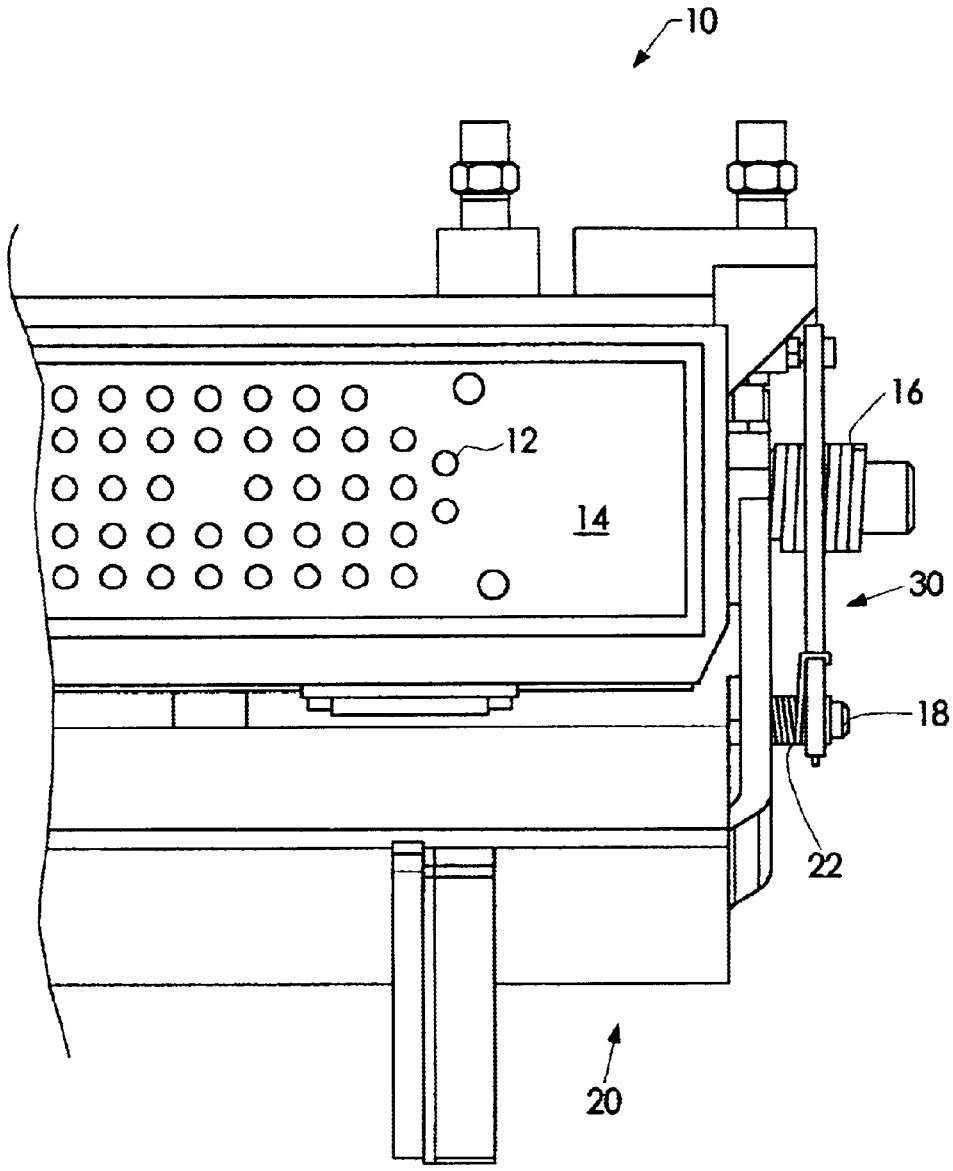
FIG. 3 is a front view of the electric coupler illustrated in FIGS. 1 and 2 depicting the presently preferred embodiment of the invention when it is in the propped open position.

Reference is now made, more particularly, to FIGS. 1–3. Illustrated therein, is an electric coupler, generally designated 10, which will typically contain spring loaded contacts 12 (FIG. 3) which allow electrical signals to be passed between adjacent mechanically coupled transit vehicles (not shown). Electrical connections of this types are typically made by opposing contacts 12 touching each other. These contacts 12 are generally subjected to routine cleaning and maintenance after a prescribed number of service hours. As discussed above, these contacts 12 and contact block 14 are protected from moisture and debris by a spring loaded spring cover, generally designated 20. In order to assess the electrical contacts 12 and contact block 14 the swing cover 20 must be rotated approximately 35 degrees and locked into position by a propping device, generally designated 30, to counteract the opposing force that is exerted by the swing cover spring 16. Subsequent to servicing the electrical contacts 12 and contact block 14 the swing cover 20 must be returned to its normal position.

As can best be seen in FIG. 1, the electrical contacts and contact block of the electric coupler 10 are covered by the swing cover 20. This condition exists when the railway cars (not shown) are uncoupled and ready to be serviced. In this condition, the door prop 30 is stowed securely against the spring cover pivot 18. This occurs due to the spring pressure being exerted on the door prop 30 by the prop return spring 22.

In the presently preferred embodiment of the invention, the door prop 30 is secured to the swing cover arm via a shoulder bolt 18 which serves as the spring cover pivot. Went becomes necessary to access the electrical contacts 12 and contact block 14, the swing cover mechanism 20 is rotated counterclockwise, (see FIG. 2). The door prop 20 is then pulled forward so that the prop slot 24 will be brought into alignment with the latch 26 (see FIG. 3). Once the door prop 20 is the engaged, the positive pressure exerted by the prop return spring 22 and the swing cover spring 16 forces the prop slot 24 around the latch bolt 26 (FIG. 2), thus ensuring that the door prop 20 will not accidentally disengage.

There is provided an anti-rotation arm 28 attached to the door prop 20 which limits the rotation of such door prop 20. This serves two purposes. First, it prevents the prop return spring 22 from becoming overstressed due to the over-rotation of the door prop 20. Secondly, the anti-rotation arm 28 will limit the rotation of the complete door prop unit 20. Since the door prop 20 cannot rotate beyond the latch bolt 26, the door prop 20 cannot dangle below the electric coupler 10 while not in use. Therefore, the door prop 20 is completely confined to the area between the latch bolt 26 and the spring cover pivot 18.

As discussed above, the present method of propping the swing door cover open consists of a prop which is similar to the present invention. However, the present door prop cannot be contained within a predetermined area. Therefore the present door prop can rotate past the latch bolt 26 and dangle below the electric coupler 10. This is an undesirable condition.

It is apparent that the present invention is an improvement to the current door prop configuration. The door prop 20, according to the present invention, is safe, reliable and easy to operate.

While in accordance with patent statutes, a presently preferred embodiment, as well as the number of alternative embodiments, have been described in detail above, it should be recognized that various other modifications and adaptations of the present invention can be made by those persons who are skilled in the relevant art from the description without departing from the spirit of the invention and the scope of the appended claims.

We claim:

1. A swing door cover prop device for an electric coupler used on a passenger transit vehicle, said swing door cover prop device comprising:

(a) an elongated door prop member having a first end and a second end;

(b) a slot disposed adjacent said first end of said elongated door prop member for engaging a latch bolt disposed on such swing cover;

(c) a means engageable with said second end of said elongated door prop member for pivotably connecting said elongated door prop member to a swing cover arm of such electric coupler; and (d) a spring means disposed between said elongated door prop member adjacent said second end thereof and such swing cover arm for exerting a positive pressure on said elongated door prop member.

2. A swing cover door prop device for an electric coupler used on a passenger transit vehicle, according to claim 1, wherein said swing cover door prop device further includes a means for forcing said prop slot over such latch bolt.

3. A swing cover door prop device for an electric coupler used on a passenger transit vehicle, according to claim 2, wherein said means for forcing said prop slot over such latch bolt is a spring.

4. A swing cover door prop device for an electric coupler used on a passenger transit vehicle, according to claim 1, wherein said swing cover door prop device further includes an anti-rotation means attached to said door prop for the limiting rotation of said door prop.

5. A swing cover door prop device for an electric coupler used on a passenger transit vehicle, according to claim 1, wherein said means engageable with said second end of said door prop member for pivotally connecting said door prop member to a swing cover arm of such electric coupler includes a shoulder bolt.

* * * * *